US008783745B2

(12) United States Patent
Salvador et al.

(10) Patent No.: US 8,783,745 B2
(45) Date of Patent: Jul. 22, 2014

(54) FAIL SAFE LOCKING OVERSHOT DEVICE

(75) Inventors: Patrick Salvador, North Bay (CA); Paul Lambert, North Bay (CA)

(73) Assignee: Atlas Copco Canada Inc, Québec (CA)

( * ) Notice: Subject to any disclaimer, the term of this patent is extended or adjusted under 35 U.S.C. 154(b) by 0 days.

(21) Appl. No.: 13/882,093

(22) PCT Filed: Nov. 22, 2011

(86) PCT No.: PCT/CA2011/001288

§ 371 (c)(1), (2), (4) Date: Apr. 26, 2013

(87) PCT Pub. No.: WO2012/068674

PCT Pub. Date: May 31, 2012

(65) Prior Publication Data

US 2013/0214546 A1 Aug. 22, 2013

(30) Foreign Application Priority Data

Nov. 22, 2010 (WO) ..... PCT/CA2010/001877

(51) Int. Cl.
*E21B 31/18* (2006.01)

(52) U.S. Cl.
USPC ..... 294/86.29; 294/86.26; 294/86.17

(58) Field of Classification Search
CPC ..... E21B 31/18; E21B 31/12; E21B 25/02; E21B 31/125; E21B 23/00
USPC ..... 294/86.26, 86.27, 86.28, 86.29, 86.3, 294/86.31, 86.33, 86.2, 86.17, 86.19, 294/86.15; 166/301, 98
See application file for complete search history.

(56) References Cited

U.S. PATENT DOCUMENTS

| | | | | | |
|---|---|---|---|---|---|
| 474,080 | A | * | 5/1892 | Bullock et al. | 175/239 |
| 672,154 | A | * | 4/1901 | Taylor | 294/86.12 |
| 720,078 | A | * | 2/1903 | Smith et al. | 294/86.28 |
| 1,315,581 | A | * | 9/1919 | Scott | 294/86.27 |
| 1,719,144 | A | | 7/1929 | Stokes et al. | |
| 1,732,563 | A | * | 10/1929 | Koppl | 294/86.22 |
| 2,296,397 | A | * | 9/1942 | Muhlbach | 294/86.18 |
| 2,507,127 | A | * | 5/1950 | True | 294/199 |
| 3,758,145 | A | * | 9/1973 | Kinley | 294/86.29 |
| 4,004,835 | A | | 1/1977 | Taylor | |

(Continued)

FOREIGN PATENT DOCUMENTS

| | | | |
|---|---|---|---|
| GB | 206277 | A | 11/1923 |
| WO | WO-02092960 | A1 | 11/2002 |

OTHER PUBLICATIONS

PCT/ISA/210—International Search Report—Jan. 18, 2012 (Issued in PCT/CA2011/001288).

(Continued)

*Primary Examiner* — Saul Rodriguez
*Assistant Examiner* — Gabriela Puig
(74) *Attorney, Agent, or Firm* — Venable LLP; Eric J. Franklin

(57) ABSTRACT

A fail safe locking overshot device. The overshot device is connected to a hoisting line for retrieval of a spearhead. The device provides automatic engagement of a mechanical locking system through locking dogs for locking the lifting dogs after capture of a spearhead. Manual disengagement is required to unlock the lifting dogs and release the spearhead.

34 Claims, 4 Drawing Sheets

(56) References Cited

U.S. PATENT DOCUMENTS

| | | | | |
|---|---|---|---|---|
| 4,834,198 | A * | 5/1989 | Thompson | 175/244 |
| 6,019,181 | A * | 2/2000 | Soinski et al. | 175/58 |
| 6,089,335 | A * | 7/2000 | Able | 175/246 |
| 6,564,885 | B2 * | 5/2003 | Attwater | 175/235 |
| 6,820,703 | B1 * | 11/2004 | Borg | 175/58 |
| 6,848,506 | B1 | 2/2005 | Sharp et al. | |
| 6,997,493 | B2 * | 2/2006 | Beach | 294/86.27 |
| 7,427,091 | B2 * | 9/2008 | Streater et al. | 294/86.27 |
| 2004/0195852 | A1 | 10/2004 | Beach | |
| 2007/0046051 | A1 | 3/2007 | Streater et al. | |
| 2009/0242203 | A1 * | 10/2009 | Pardey | 166/301 |
| 2012/0125612 | A1 * | 5/2012 | Salvador | 166/301 |
| 2013/0146365 | A1 * | 6/2013 | Salvador et al. | 175/250 |

OTHER PUBLICATIONS

PCT/ISA/237—Written Opinion of the International Searching Authority—Jan. 18, 2012 (Issued in PCT/CA2011/001288).

* cited by examiner

FAIL SAFE LOCKING OVERSHOT DEVICE

CROSS-REFERENCE TO RELATED APPLICATIONS

This application claims priority to PCT/CA2010/001877 filed 22 Nov. 2010 and is the national phase under 35 U.S.C. §371 of PCT/CA2011/001288 filed 22 Nov. 2010.

FIELD OF THE INVENTION

The present invention relates to a device comprising an overshot for handling an inner tube assembly after each drilling cycle, for example. More specifically, it relates to a fail safe locking overshot device and a method for operating such a device.

BACKGROUND OF THE INVENTION

During diamond drilling for geotechnical application or mining exploration, an inner-tube is filled up with rock core. When the inner-tube is full, the operator needs to recover it. The inner-tube is linked with a head assembly or back end that permits to recover the inner-tube.

An overshot is used like a fishing system to grab the head assembly. The overshot is in turn linked with a steel wire comprised in a wire line hoist system. When an overshot and an inner tube are pulled out of a rod string for core recovery, there is a possibility that the overshot releases the spear head assembly by accident. If this happens, there is risk for workers injury and damage to the equipment.

U.S. Pat. No. 6,997,493 teaches a lockable overshot comprising an elongated body, lifting dogs and a locking sleeve. The ends of the lifting dogs are configured for latching a conventional spearhead point therebetween. A locking sleeve is rotatable on the body between a locked state preventing ends of the lifting dogs from pivoting away from each other to release a previously latched spearhead point, and an unlocked state where the locking sleeve allows the lifting dogs to move so that the ends can be pivoted away from each other to release a previously latched spearhead point.

When the overshot goes out of the rod string, the operators have to stop, to lock, retrieve, unlock manually by rotating the locking sleeve into the unlocked position and manually pivot the two lifting dogs to separate the overshot from the spearhead assembly and get the core sample out. This is time consuming. Further, there is possibility operators choose not to lock the overshot at all. The operation can be difficult if dirt is present in the mechanism. At that time there is a risk for an accident. The overshot also has the possibility to accidentally release the spearhead while still in the drill string, dropping the inner tube assembly to the bottom of the hole, causing damage to equipment.

U.S. Pat. No. 4,004,835 teaches an overshot comprising a tubular sleeve and a scissor like mechanism arranged moving as a unit. A spring bearing on the top end of the scissors tends to force them down into closing movement against an inner taper of the bottom ring of the tubular sleeve. The solution permits downward movement which releases the fishing neck. This avoids placing undue strain on the overshot.

U.S. Pat. No. 7,427,091 discloses a spearhead overshot for use as part of a cable-guided fishing assembly to remove downhole tools in an oil or gas well. It uses pivot lugs to capture and release the spearhead. However, a two-pronged release tool is required to remove the spearhead.

Thus, there are needs to increase the safety and efficiency when working with an overshot. These needs cannot be fulfilled by overshots according to the above-mentioned prior art known to the Applicant.

SUMMARY OF THE INVENTION

It is an object of the present invention to provide a device with an overshot device that addresses at least one of the above-mentioned needs.

According to the present invention, there is provided a device with an overshot device comprising:

- an elongated body adapted to be connected to a hoisting line in one end and with a tubular opening receiving a spearhead in the other end, said elongated body comprising a locking dog support structure;
- at least one lifting dog comprising first and second lifting lugs each arranged to pivot around a lifting dog pivot pin, said lifting lugs being configurable between a spearhead latched configuration and a spearhead unlatched configuration, each lifting lug comprising a spearhead capture member and a spearhead release member, the spearhead capture member being adapted to capture the spearhead;
- lifting dog biasing means connecting the lifting lugs and urging the lifting lugs towards the spearhead latched configuration;
- at least one locking dog comprising first and second locking lugs each arranged to pivot around a locking dog pivot pin, said locking lugs being configurable between a lifting dog locked configuration and a lifting dog unlocked configuration, each locking lug comprising a lifting dog locking member, the lifting dog locking member being adapted to lock the lifting dogs in the spearhead latched configuration;
- locking lug biasing means connected to the locking lugs and urging the locking lugs towards the lifting lug locked configuration; and
- an engagement member capable of movement with respect to the elongated body, the at least one lifting dog and the at least one locking dog;

wherein movement of the locking lugs is arranged to force the at least one locking dog into the lifting dog unlocked configuration in which the lifting dog locking members releasably interlock with the locking dog support structure.

According to another aspect of the present invention, the invention provides a device with an overshot device comprising:

- an elongated body adapted to be connected to a hoisting line in one end and with a tubular opening receiving a spearhead in the other end, said elongated body comprising:
  - first and second axially extending slots;
  - first and second locking dog seats;
- two lifting dogs comprising first and second lifting lugs arranged to pivot around a common lifting dog pivot pin, said lifting lugs being configurable between a spearhead latched configuration and a spearhead unlatched configuration, each lifting lug comprising a spearhead capture member and a spearhead release member, the spearhead capture member being adapted to capture the spearhead, the two lifting dogs being axially slidable with respect to the elongated body;
- lifting dog biasing means connecting the lifting lugs and urging the lifting lugs towards the spearhead latched configuration;

two locking dogs comprising first and second locking lugs arranged to pivot around a common locking dog pivot pin, said locking lugs being configurable between a lifting dog locked configuration and a lifting dog unlocked configuration, each locking lug comprising a lifting dog locking member and a lifting dog release member, the lifting dog locking member being adapted to lock the lifting dogs in the spearhead latched configuration, the two locking dogs being axially slidable with respect to the elongated body;

locking dog biasing means connecting the locking lugs and urging the locking lugs towards the lifting lug locked configuration; and a pair of sliding bars connected to the common lifting dog pivot pin, and further connected therebetween with a lifting dog retention pin;

wherein downward axial movement of the locking dogs is arranged to force the locking dogs into the lifting dog unlocked configuration in which the lifting dog locking members releasably interlock with the first and second locking dog seats, and wherein upward actuation of the lifting dog retention pin displaces the pair of sliding bars along the axially extending slots of the elongated body and into contact with the lifting dog locking members thereby separating the lifting dog locking members from the first and second locking dog seats and configuring the locking lugs in the lifting dog locked configuration.

The solution according to the invention provides an overshot where the risk of accidental release of a head assembly is eliminated.

The solution may also be adapted with pump-in seals to be used in an underground application.

Further, the solution according to the invention provides a safe and secure way of operating an overshot. The solution lends the operator full control of locking and releasing an overshot.

According to another aspect of the present invention, the invention provides a method of operating an overshot device comprising:

a) providing an overshot device comprising:

an elongated body adapted to be connected to a hoisting line in one end and with a tubular opening receiving a spearhead in the other end, said elongated body comprising:

first and second axially extending slots;

first and second locking dog seats;

two lifting dogs comprising first and second lifting lugs arranged to pivot around a common lifting dog pivot pin, said lifting lugs being configurable between a spearhead latched configuration and a spearhead unlatched configuration, each lifting lug comprising a spearhead capture member and a spearhead release member, the spearhead capture member being adapted to capture the spearhead, the two lifting dogs being axially slidable with respect to the elongated body;

lifting dog biasing means connecting the lifting lugs and urging the lifting lugs towards the spearhead latched configuration;

two locking dogs comprising first and second locking lugs arranged to pivot around a common locking dog pivot pin, said locking lugs being configurable between a lifting dog locked configuration and a lifting dog unlocked configuration, each locking lug comprising a lifting dog locking member and a lifting dog release member, the lifting dog locking member being adapted to lock the lifting dogs in the spearhead latched configuration, the two locking dogs being axially slidable with respect to the elongated body;

locking dog biasing means connecting the locking lugs and urging the locking lugs towards the lifting lug locked configuration; and a pair of sliding bars connected to the common lifting dog pivot pin, and further connected therebetween with a lifting dog retention pin;

b) lowering the locking dogs to force the locking dogs into the lifting dog unlocked configuration in which the lifting dog locking members releasably interlock with the first and second locking dog seats; and c) raising upward the lifting dog retention pin to displace the pair of sliding bars along the axially extending slots of the elongated body and into contact with the lifting dog locking members thereby separating the lifting dog locking members from the first and second locking dog seats and configuring the locking lugs in the lifting dog locked configuration.

The overshot according to the invention is a mechanism for latching onto a spearhead that greatly reduces the chances of accidental release of the spearhead. This in turn improves the secure operation of the overshot and assures a safer operation of the overshot.

According to a third aspect of the invention, the invention provides an use of an overshot as described above in an underground application in conjunction with an underground adapter with a propulsion seal to propel the overshot through the drill string (not shown) using fluid under pressure.

According to another aspect of the present invention, the invention provides a pivotable lifting lug comprising:

a spearhead release member for releasing a spearhead, the spearhead release member comprising:

main pivoting means connectable to a lifting lug pivoting element; and a release arm extending at an extremity of the spearhead release member;

a spearhead capture member for capturing the spearhead, the spearhead capture member comprising:

a spearhead capture tip; and a release arm support portion opposite the spearhead capture tip and having a shape substantially complementary to a shape of the release arm;

common pivoting means for pivotably connecting the spearhead release member to the spearhead capture member; and lifting lug biasing means for urging the spearhead capture member against the release arm of the spearhead release member.

The overshot according to the present invention provides the following advantages over existing designs that are known to the Applicant:

One handed release of the spearhead

Slack in a wire line is not required to release the spearhead. The spear head is not required to be fully inserted prior to release.

No small parts, more durable parts

The locking mechanism is automatically set when inserting the spearhead

The unlocking mechanism does not require spearhead to be fully re-inserted.

When in locked position, there is no possibility to accidentally press in the release end of the lifting dogs, releasing the spearhead.

The spearhead may be inserted when the overshot is in a locked configuration.

BRIEF DESCRIPTION OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

PREFERRED EMBODIMENTS OF THE PRESENT INVENTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the feature up/upwards is defined as a direction axially along the overshot towards the hoisting line connection. The feature down/downwards is defined as a direction axially along the overshot towards the head assembly i.e. same as the direction of the force of gravity. The words "inner", "inwardly" and "outer", "outwardly" refer to directions toward and away from, respectively, a designated axis or a geometric center of an element being described, the particular meaning being readily apparent from the context of the description. The terminology includes the words specifically mentioned above, derivatives thereof, and words or similar import.

Figure 1:
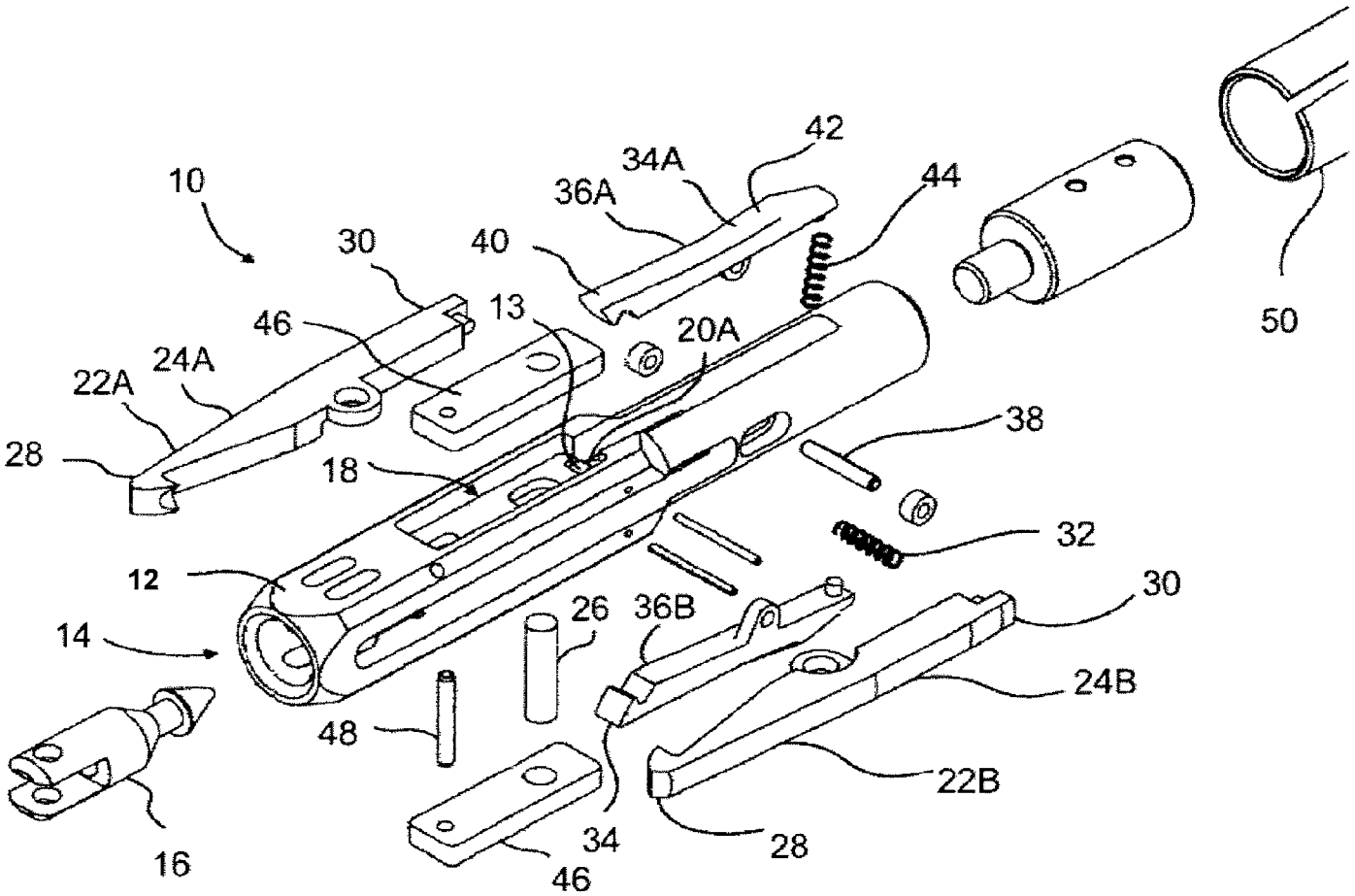
FIG. 1 is an exploded perspective view of the overshot device according to a preferred embodiment of the present invention.
Figure 2:
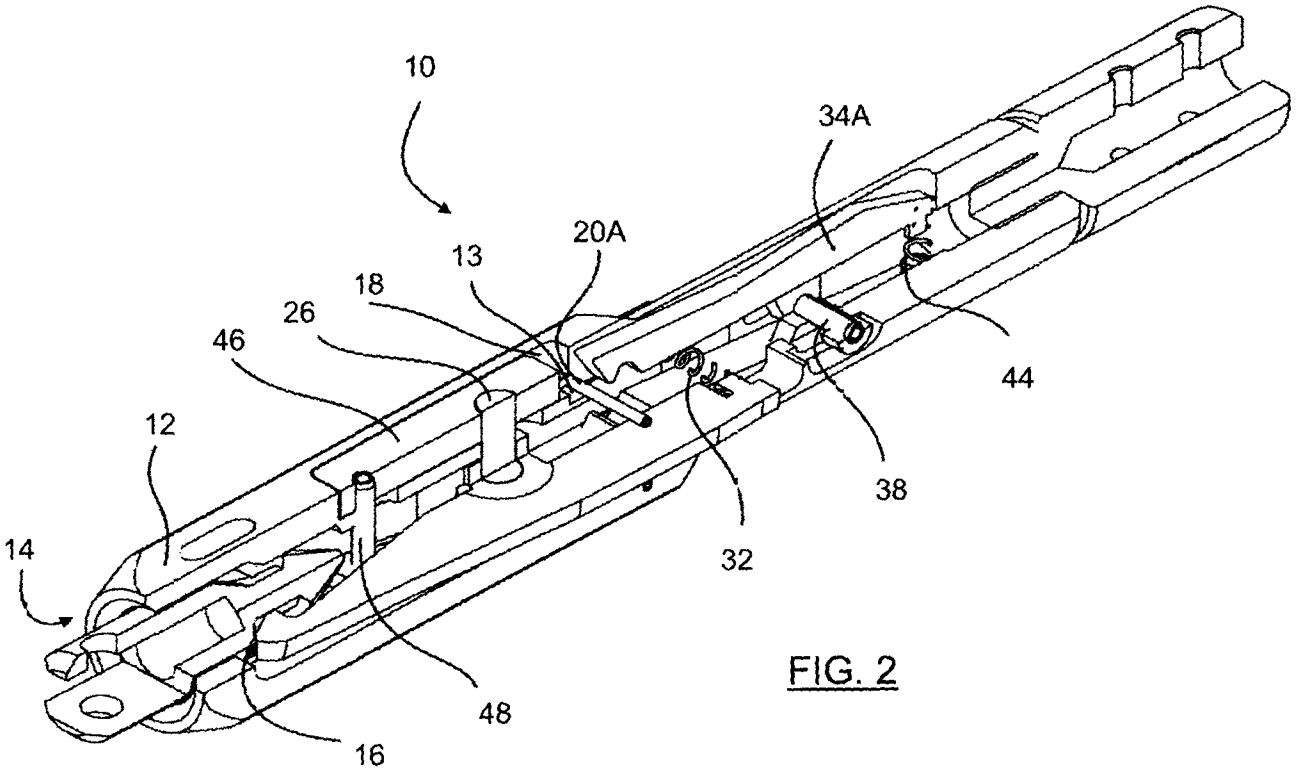
FIG. 2 is a partially cut perspective view of the overshot device shown in FIG. 1.

Referring now to the drawings in detail, wherein like numbers are used to indicate like elements throughout, there is shown in FIGS. 1 and 2 a presently preferred embodiment of an overshot device 10.

The overshot device 10 comprises an elongated body 12 adapted to be connected to a hoisting line in one end and with a tubular opening 14 receiving a spearhead 16 in the other end. The elongated body 12 has a locking dog support structure 13.

The overshot device 10 also comprises at least one lifting dog 22A comprising first and second lifting lugs 24A,24B each arranged to pivot around a lifting dog pivot pin 26. The lifting lugs 24A,24B are configurable between a spearhead latched configuration and a spearhead unlatched configuration. Each lifting lug 24A,24B comprises a spearhead capture member 28 and a spearhead release member 30. The spearhead capture member 28 is adapted to capture the spearhead 16.

Lifting dog biasing means 32 connect the lifting lugs 24A, 24B and urge the lifting lugs 24A,24B towards a spearhead latched configuration.

The overshot device 10 further comprises at least one locking dog 34A comprising first and second locking lugs 36A, 36B. The locking lugs 36A,36B are configurable between a lifting dog locked configuration and a lifting dog unlocked configuration. Each locking lug 36A,36B comprises a lifting dog locking member 40 and a lifting dog release member 42. The lifting dog locking member 40 is adapted to lock the lifting dogs 22A,22B in the spearhead latched configuration.

Locking lug biasing means 44 connect the locking lugs 36A,36B and urge the locking lugs 36A,36B towards the lifting lug locked configuration.

The device also comprises an engagement member 46 capable of movement with respect to the elongated body, the at least one lifting dog and the at least one locking dog;

Movement of the locking lugs 36A,36B is arranged to force the locking dog 34A into the lifting dog unlocked configuration in which the lifting dog locking members 40 releasably interlock with the locking dog support structure 13.

Preferably, the first and second lifting lugs 24A,24B are each arranged to pivot around a common lifting dog pivot pin 26.

Preferably, the first and second locking lugs 36A,36B are each arranged to pivot around a common locking dog pivot pin.

Preferably, the lifting lugs 24A,24B are axially slidable with respect to the elongated body 12.

In another embodiment of the present invention, the lifting lugs 24A,24B may be axially fixed with respect to the elongated body 12.

Preferably, the locking lugs 36A,36B are axially slidable with respect to the elongated body 12.

In another embodiment of the present invention, the locking lugs 36A,36B are axially fixed with respect to the elongated body 12.

In one embodiment of the present invention, actuation by the spearhead entering the elongated body 12 displaces the locking lugs 36A,36B from the lifting dog unlocked position to the lifting dog locked position.

In another embodiment of the present invention, actuation by the spearhead entering into contact with the at least one lifting dog 22A displaces the locking lugs 36A,36B from the lifting dog unlocked position to the lifting dog locked position.

In yet another embodiment of the present invention, actuation by movement of the engagement member 46 displaces the locking lugs 36A,36B from the lifting dog unlocked position to the lifting dog locked position.

Preferably, the engagement member 46 comprises at least one sliding bar.

Preferably, the lifting dog biasing means 32 comprises a spring connecting the spearhead release members of the lifting lugs.

Preferably, the locking lug biasing means 44 comprises a spring biasing the locking lugs to the lifting dog locked configuration.

Preferably, the locking lugs 36A,36B inhibit movement of spearhead release members of the at least one lifting dog 22A when the locking lugs 36A,36B are in the lifting dog locked configuration.

Preferably, the device 10 further comprises a releasing sleeve 50 sized to slide axially along the elongated body 12, to compress the lifting dog release members such that the locking lugs 36A,36B are in the lifting lug unlatched configuration upon a first displacement of the sleeve towards the tubular opening of the elongated body, and to further compress the spearhead release members such that the lifting lugs 24A,24B are in the spearhead unlatched configuration upon a second further displacement of the sleeve towards the tubular opening of the elongated body 12.

Another embodiment of the present of the present invention will now be described hereinbelow. The overshot device 10 comprises an elongated body 12 adapted to be connected to a hoisting line in one end and with a tubular opening 14 receiving a spearhead 16 in the other end. The elongated body 12 has first and second axially extending slots 18A,18B, as well as first and second locking dog seats 20A,20B. The elongated body 12 with the opening on one end is able to accept a conventional spearhead while being connected to a wireline hoist on the opposite end.

The overshot device 10 also comprises two lifting dogs 22A,22B comprising first and second lifting lugs 24A,24B arranged to pivot around a common lifting dog pivot pin 26. The lifting lugs 24A,24B are configurable between a spearhead latched configuration and a spearhead unlatched configuration. Each lifting lug 24A,24B comprises a spearhead capture member 28 and a spearhead release member 30. The spearhead capture member 28 is adapted to capture the spearhead 16. The two lifting dogs 22A,22B are axially slidable with respect to the elongated body 12.

Lifting dog biasing means 32 connect the lifting lugs 24A, 24B and urge the lifting lugs 24A,24B towards a spearhead latched configuration.

Preferably, the lifting dog biasing means 32 comprises a compression spring connecting the spearhead release members 30 of the lifting lugs 24A,24B. However, any other suitable spring may be used.

The pair of lifting dogs 22A,22B can latch onto a conventional spearhead on one end. The compression spring on the opposite end biases the lifting dogs to close to grip the spearhead. The common pivot pin 26 is movable within a slot in the overshot head or elongated body 12.

The overshot device 10 further comprises two locking dogs 34A,34B comprising first and second locking lugs 36A,36B arranged to pivot around a common locking dog pivot pin 38. The locking lugs 36A,36B are configurable between a lifting dog locked configuration and a lifting dog unlocked configuration. Each locking lug 36A,36B comprises a lifting dog locking member 40 and a lifting dog release member 42. The lifting dog locking member 40 is adapted to lock the lifting dogs 22A,22B in the spearhead latched configuration. The two locking dogs 34A,34B are axially slidable with respect to the elongated body 12.

Locking dog biasing means 44 connect the locking lugs 36A,36B and urge the locking lugs 36A,36B towards the lifting lug locked configuration.

Preferably, the locking dog biasing means 44 comprises a compression spring connecting the lifting dog release members 42 of the locking lugs 36A,36B. However, any other suitable spring may be used.

The overshot device 10 also comprises a pair of sliding bars 46 connected to the common lifting dog pivot pin 26, and further connected therebetween with a lifting dog retention pin 48.

Downward axial movement of the locking dogs 34A,34B is arranged to force the locking dogs into the lifting dog unlocked configuration in which the lifting dog locking members 40 releasably interlock with the first and second locking dog seats 20A,20B. Upward actuation of the lifting dog retention pin 48 displaces the pair of sliding bars 46 along the axially extending slots 18A,18B of the elongated body 12 and into contact with the lifting dog locking members thereby separating the lifting dog locking members 40 from the first and second locking dog seats 20A,20B and configuring the locking lugs 36A,36B in the lifting dog locked configuration.

Preferably, the lifting dog locking members 40 of the locking dogs 34A,34B are arranged to be positioned between the spearhead release members 30 of the lifting dogs 22A,22B when the locking lugs 36A,36B are in the lifting dog locked configuration.

Preferably, as described above, the pair of locking dogs 34A,34B are biased on one end by the compression spring 44 closing the lifting dog locking members 40 together. When the locking dogs 34A,34B are closed, they are in a position in between the releasing members 30 of the lifting dogs to prevent the lifting dog to release the spearhead 16. The geometry of the lifting dog locking members 40 of the locking lugs is designed to easily move them into the unlocked position and latch into geometry on the overshot head, through the seats 20A,20B. As the spearhead 16 forces the lifting dog assembly to an upward position, the sliding bars 46 will interfere with the locking dogs 34A,34B that are latched in the unlocked position, thus forcing the locking dogs 34A,34B to unlatch from the overshot head or elongated body 12 and into its locked position. The lifting dog retention pin 48 attached to both of the sliding bars 46 prevents the lifting dogs 22A,22B from rotating out of the overshot head or elongated body 12. The lifting dog retention pin 48 also allows for the spearhead 12 to push the lifting dog assembly to the up position when fully inserted in the overshot head.

Preferably a releasing sleeve 50 may be provided. It is sized to slide axially along the elongated body 12, to compress the lifting dog release members 42 such that the locking lugs 36A,36B are in the lifting lug unlatched configuration upon a first displacement of the sleeve 50 towards the tubular opening of the elongated body. The sleeve 50 further compresses the spearhead release members 30 such that the lifting lugs 24A,24B are in the spearhead unlatched configuration upon a second further displacement of the sleeve 50 towards the tubular opening 14 of the elongated body 12. This feature is useful for dry hole lowering or for releasing the overshot from a stuck innertube assembly inside the hole, where the releasing sleeve is used in the same was as conventional overshot assemblies. The weight and momentum of the releasing sleeve 50 travelling downward will compress the spring 44 on the locking dogs and move them into the unlocked position. It will travel further down and overlap the spearhead release members of the lifting dogs when the spearhead is fully inserted in the overshot, holding them in the released position. The overshot can now be retrieved from the hole without the inner-tube assembly.

According to the present invention there is also provided a method of operating an overshot device comprising:

a) providing an overshot device as described above;

b) lowering the locking dogs to force the locking dogs into the lifting dog unlocked configuration in which the lifting dog locking members releasably interlock with the first and second locking dog seats; and c) raising upward the lifting dog retention pin to displace the pair of sliding bars along the axially extending slots of the elongated body and into contact with the lifting dog locking members thereby separating the lifting dog locking members from the first and second locking dog seats and configuring the locking lugs in the lifting dog locked configuration.

Preferably, step c) of raising is accomplished with the spearhead entering the tubular opening of the elongated body.

Preferably, the method further comprises:

d) sliding a releasing sleeve axially along the elongated body, to compress the lifting dog release members such that the locking lugs are in the lifting lug unlatched configuration upon a first displacement of the sleeve towards the tubular opening of the elongated body, and to further compress the spearhead release members such that the lifting lugs are in the spearhead unlatched configuration upon a second further displacement of the sleeve towards the tubular opening of the elongated body.

A typical operation may therefore be described as follows.

Before lowering the overshot in the drill string, the locking dogs 34A,34B are moved down and latched onto the overshot head or elongated body 12 in the unlocked position through the seats 20A,20B. This allows the spearhead release members 30 of the lifting dogs 22A,22B to come together when the spearhead 16 enters the overshot or elongated body 12.

At the bottom of the hole, the overshot will land on the head assembly. As the spearhead 16 enters the overshot or elongated body 12, the lifting dog assembly is forced upward causing the sliding bars 46 to hit the locking dogs 34A,34B, unlatching them from their unlocking position. The spring 44 on locking dogs bias the lifting dog locking members 40 to come together, at this point they are pushing in on the side of the spearhead release members 30.

When the slack is removed from the wireline and retrieval of the innertube assembly begins, the spearhead 16 will travel slightly out of the head, the lifting dogs 22A,22B will grab onto the neck of the spearhead 16 and move with the spearhead 16 to a down position. In this position, the spearhead release members 30 of the lifting dogs 22A,22B are moved apart by the spring 32 due to the smaller diameter of the spearhead neck. This allows the locking dogs 34A,34B to move in between the two spearhead release members 30 preventing them from moving inward to release the spearhead. The inner-tube assembly can now be handled with reduced fear of accidental release of the overshot.

To release the spearhead 16, the locking dogs 34A34B are moved to latch onto the head or elongated body 12 in the unlocked position through the seats 20A,20B. The lifting dogs 22A,22B can now be used in the conventional way to release the spearhead 16 by moving the spearhead release members 30 of the lifting dogs 22A,22B inward.

In some overshot devices, a safety feature may be added in order to prevent inward movement of the spearhead release member 30 of the lifting lug 24B and thus lock the spearhead in the overshot. However, if the safety feature is engaged prior to entry of the spearhead in the overshot, the safety device will effectively prevent the spearhead from entering the overshot head. Consequently, there is also a need for a lifting lug that will allow entry of the spearhead in the overshot head in conditions where the spearhead release member is in a locked configuration According to the present invention, there is also provided a pivotable lifting lug comprising a spearhead release member 30 for releasing a spearhead. The spearhead release member 30 includes main pivoting means 31 connectable to a lifting lug pivoting element and a release arm 33 extending at an extremity of the spearhead release member 30. The pivotable lifting lug also comprises a spearhead capture member 28 for capturing the spearhead. The spearhead capture member includes a spearhead capture tip 35 and a release arm support portion 37 opposite the spearhead capture tip 35 and having a shape substantially complementary to a shape of the release arm 33. Common pivoting means 52 are also provided for pivotably connecting the spearhead release member 30 to the spearhead capture member 28. Lifting lug biasing means 53 urge the spearhead capture member 28 against the release arm 33 of the spearhead release member 30.

Preferably, the pivotable lifting lug may be used in the place of lifting lugs in existing overshot devices, using the same main pivoting means and overall dimensions in order to follow similar motions for engaging and disengaging the spearhead. The capture member 28 can hook onto the spearhead and the release member 30 can manually release the spearhead. Preferably, the common pivoting means 52 is common pivot linking the capture and release members with biasing means to bias the capture member 28 against the release arm 33 of the release member 30. Consequently, if the release member is in a locked configuration, the capture member 28 can pivot to an open position through contact with the spearhead. Given that the position of the pivot point on the capture member is close to the edge of the capture member, the only means for the capture member 28 to pivot open is by contact with the spearhead. The common pivoting means 52 may be a pin or other type of connection, such as a slotted connection, providing rotational or linear movement between the capture member 28 and the release member 30 that will allow the spearhead to enter the overshot device. The only means of release after capture of the spearhead is then to actuate the release member 30. The lifting lug biasing means can be a compression spring, extension spring, leaf spring, elastomer type material or any other device or material. The release member may further include a spring post 55 for connecting the release member 30 to the lifting dog biasing means 32, such as a spring.

As mentioned above, for certain other applications, the overshot device may be connected to an underground adapter comprising a propulsion seal and support washer. The overshot according to the invention may be further adapted with pump-in seals to be used in an underground applications. The adapter may be directly or indirectly mounted on the overshot device.

Figure 3:
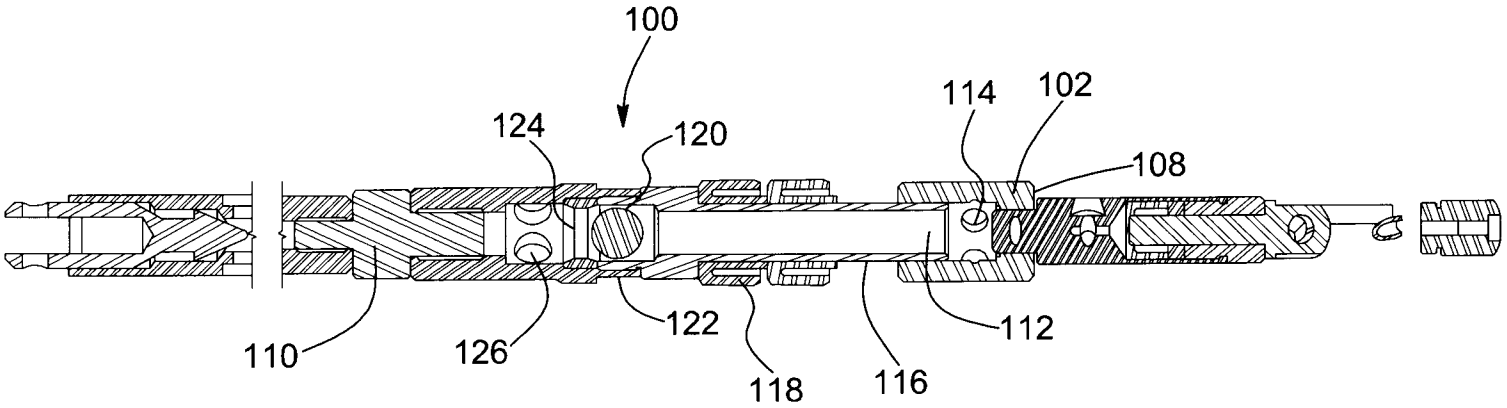
FIG. 3 is a cross-sectional side view of an adapter to be used in conjunction with the overshot device, according to a preferred embodiment of the present invention.
Figure 4C:
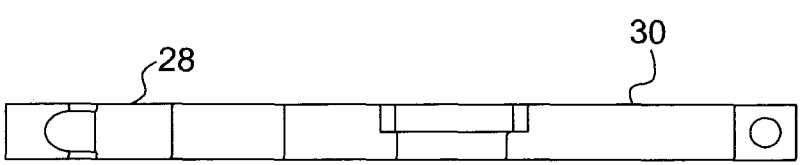
FIGS. 4A to 4D are perspective, front, top and side views respectively of the pivotable lifting lug according to a preferred embodiment of the present invention.
Figure 4D:
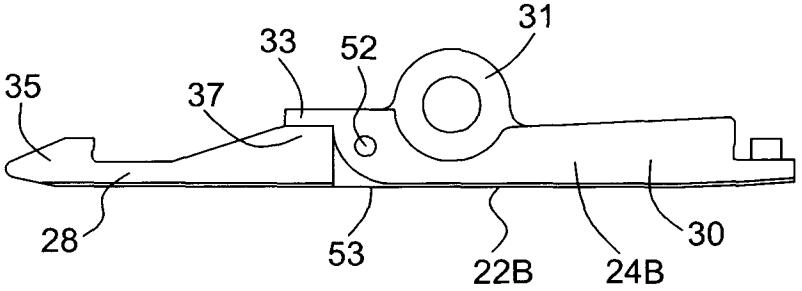
Figure 4A:
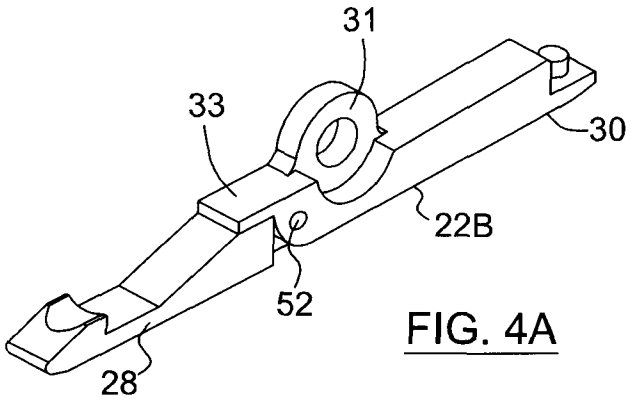
Figure 4B:
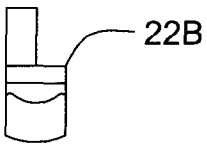

Preferably, as shown in FIG. 3, the adapter 100 comprises an upper latch body 102, a lower latch body 104, a valve system, a wireline retention device 108, and a coupling device 110. The upper latch body 102 comprises an upper central bore 112 and an upper port system 114 for fluidly connecting an outer surface of the upper latch body 102 to the upper central bore 112. The upper latch body 102 also has a reduced diametric portion 116 below the upper central bore 112 for receiving at least one seal member 118. The reduced diametric portion 116 includes a lower coupling portion 120 on a bottom portion thereof.

The lower latch body 104 has an upper coupling portion 122 coupled to the lower coupling portion 120 of the upper latch body 102. The lower latch body 104 also includes a lower central bore 124, in fluid communication with the upper central bore 112. The lower latch body 104 also as a lower port system 126 for fluidly connecting an outer surface of the lower latch body 104 to the lower central bore 124.

The valve system controls fluid flow between the upper port system 114 and the lower port system 126. The wireline retention device 108 is mounted above the upper latch body 102. The coupling device 110 couples the lower latch body 104 to the overshot device 10.

More generally, the adapter is adaptable to an overshot head and contains a valve system, propulsion seals and cable swivel. The coupling device, valve body and seal seat may be one or more parts, mounted directly or indirectly to the overshot head. The valve system may be a ball and bushing or any type of valve mechanism to block fluid flow for pumping and allow fluid flow for retrieval of the overshot. The valve location is between the upper and lower port systems and is located in between the first and last ports if the port systems include more than two ports. The propulsion seals that correspond to the seal members are mounted between the upper and lower port systems and are located in between the first and last ports if the port systems include more than two ports.

More particularly, the adapter can be used with existing or similar overshot devices. The adapter can be coupled to the overshot head on one end and coupled to an existing valve member or common parts having a similar function on the other end. The valve system on the lower latch body has a function of substantially blocking fluid flow during the pumping process and alternatively to allow fluid to flow during the retrieval process. The lower latch body may be further provided with a seal seat to mount one or more propulsion seals mounted outwardly of the valve. The adapter may also be provided with a wireline retention device for securing the wireline to the overshot assembly. The wireline retention device is made rotatable to reduce twist in wireline. The adapter can be used to adapt existing parts to an overshot head.

A significant feature of the present invention with respect to the prior art known to the Applicant is the automatic engagement of a mechanical lock (through the locking dogs) for locking the lifting dogs, while requiring manual disengagement to unlock the lifting dogs.

Although preferred embodiments of the present invention have been described in detail herein and illustrated in the accompanying drawing, it is to be understood that the invention is not limited to these precise embodiments and that various changes and modifications may be effected therein without departing from the scope of the present invention.

The invention claimed is:

1. A device with an overshot device comprising:

an elongated body adapted to be connected to a hoisting line in one end and with a tubular opening receiving a spearhead in the other end, said elongated body comprising a locking dog support structure;

at least one lifting dog comprising first and second lifting lugs each arranged to pivot around a lifting dog pivot pin, said lifting lugs being configurable between a spearhead latched configuration and a spearhead unlatched configuration, each lifting lug comprising a spearhead capture member and a spearhead release member, the spearhead capture member being adapted to capture the spearhead;

a lifting dog biasing element configured to connect the lifting lugs and urge the lifting lugs towards the spearhead latched configuration;

at least one locking dog comprising first and second locking lugs each arranged to pivot around a locking dog pivot pin, said locking lugs being configurable between a lifting dog locked configuration and a lifting dog unlocked configuration, each locking lug comprising a lifting dog locking member, the lifting dog locking member being adapted to lock the lifting dogs in the spearhead latched configuration;

a locking lug biasing element configured to connect the locking lugs and urge the locking lugs towards the lifting lug locked configuration; and an engagement member capable of movement with respect to the elongated body, the at least one lifting dog and the at least one locking dog;

wherein movement of the locking lugs is arranged to force the at least one locking dog into the lifting dog unlocked configuration in which the lifting dog locking members releasably interlock with the locking dog support structure.

2. The device according to claim 1, wherein the first and second lifting lugs are each arranged to pivot around a common lifting dog pivot pin.

3. The device according to claim 1, wherein the first and second locking lugs are each arranged to pivot around a common locking dog pivot pin.

4. The device according to claim 1, wherein the lifting lugs are axially slidable with respect to the elongated body.

5. The device according to claim 1, wherein the lifting lugs are axially fixed with respect to the elongated body.

6. The device according to claim 1, wherein the locking lugs are axially slidable with respect to the elongated body.

7. The device according to claim 1, wherein the locking lugs are axially fixed with respect to the elongated body.

8. The device according to claim 1, wherein actuation by the spearhead entering the elongated body displaces the locking lugs from the lifting dog unlocked position to the lifting dog locked position.

9. The device according to claim 1, wherein actuation by the spearhead entering into contact with the at least one lifting dog displaces the locking lugs from the lifting dog unlocked position to the lifting dog locked position.

10. The device according to claim 1, wherein actuation by movement of the engagement member displaces the locking lugs from the lifting dog unlocked position to the lifting dog locked position.

11. The device according to claim 1, wherein the engagement member comprises at least one sliding bar.

12. The device according to claim 1, wherein the lifting dog biasing element comprises a spring connecting the spearhead release members of the lifting lugs.

13. The device according to claim 1, wherein the locking lug biasing element comprises a spring biasing the locking lugs to the lifting dog locked configuration.

14. The device according to claim 1, wherein the locking lugs inhibit movement of spearhead release members of the at least one lifting dog when the locking lugs are in the lifting dog locked configuration.

15. The device according to claim 1, further comprising:

a releasing sleeve sized to slide axially along the elongated body, to compress the lifting dog release members such that the locking lugs are in the lifting lug unlatched configuration upon a first displacement of the sleeve towards the tubular opening of the elongated body, and to further compress the spearhead release members such that the lifting lugs are in the spearhead unlatched configuration upon a second further displacement of the sleeve towards the tubular opening of the elongated body.

16. The device according to claim 1, further comprising:

an underground adapter with a propulsion seal to propel the overshot device through the drill string using fluid under pressure.

17. The device according to claim 16, wherein the adapter is directly mounted on the device.

18. The device according to claim 16, wherein the adapter comprises:

an upper latch body comprising:

an upper central bore;

an upper port system for fluidly connecting an outer surface of the upper latch body to the upper central bore; and a reduced diametric portion below the upper central bore for receiving at least one seal member, said reduced diametric portion comprising a lower coupling portion on a bottom portion thereof;

a lower latch body comprising:

an upper coupling portion coupled to the lower coupling portion of the upper latch body;

a lower central bore, in fluid communication with the upper central bore; and a lower port system for fluidly connecting an outer surface of the lower latch body to the lower central bore;

a valve system for controlling fluid flow between the upper port system and the lower port system;

a wireline retention device mounted above the upper latch body; and a coupling device for coupling the lower latch body to the overshot device.

19. The device according to claim 1, wherein, for each lifting lug, the spearhead release member comprises:

a main pivoting element connectable to a lifting lug pivoting element; and a release arm extending at an extremity of the spearhead release member;

the spearhead capture member comprises:

a spearhead capture tip; and a release arm support portion opposite the spearhead capture tip and having a shape substantially complementary to a shape of the release arm;

each lifting lug further comprising:

a common pivoting element configured to pivotably connect the spearhead release member to the spearhead capture member; and a lifting lug biasing element configured to urge the spearhead capture member against the release arm of the spearhead release member.

20. A device with an overshot device comprising:

an elongated body adapted to be connected to a hoisting line in one end and with a tubular opening receiving a spearhead in the other end, said elongated body comprising:

first and second axially extending slots;

first and second locking dog seats;

two lifting dogs comprising first and second lifting lugs arranged to pivot around a common lifting dog pivot pin, said lifting lugs being configurable between a spearhead latched configuration and a spearhead unlatched configuration, each lifting lug comprising a spearhead capture member and a spearhead release member, the spearhead capture member being adapted to capture the spearhead, the two lifting dogs being axially slidable with respect to the elongated body;

a lifting dog biasing element configured to connect the lifting lugs and urge the lifting lugs towards the spearhead latched configuration;

two locking dogs comprising first and second locking lugs arranged to pivot around a common locking dog pivot pin, said locking lugs being configurable between a lifting dog locked configuration and a lifting dog unlocked configuration, each locking lug comprising a lifting dog locking member and a lifting dog release member, the lifting dog locking member being adapted to lock the lifting dogs in the spearhead latched configuration, the two locking dogs being axially slidable with respect to the elongated body;

a locking dog biasing element configured to connect the locking lugs and urge the locking lugs towards the lifting lug locked configuration; and a pair of sliding bars connected to the common lifting dog pivot pin, and further connected therebetween with a lifting dog retention pin;

wherein downward axial movement of the locking dogs is arranged to force the locking dogs into the lifting dog unlocked configuration in which the lifting dog locking members releasably interlock with the first and second locking dog seats, and wherein upward actuation of the lifting dog retention pin displaces the pair of sliding bars along the axially extending slots of the elongated body and into contact with the lifting dog locking members thereby separating the lifting dog locking members from the first and second locking dog seats and configuring the locking lugs in the lifting dog locked configuration.

21. The device according to claim 20, wherein the lifting dog biasing element comprises a compression spring connecting the spearhead release members of the lifting lugs.

22. The device according to claim 20, wherein the locking dog biasing element comprises a compression spring connecting the lifting dog release members of the locking lugs.

23. The device according to claim 20, wherein the lifting dog locking members of the locking dogs are arranged to be positioned between the spearhead release members of the lifting dogs when the locking lugs are in the lifting dog locked configuration.

24. The device according to claim 20, further comprising:

a releasing sleeve sized to slide axially along the elongated body, to compress the lifting dog release members such that the locking lugs are in the lifting lug unlatched configuration upon a first displacement of the sleeve towards the tubular opening of the elongated body, and to further compress the spearhead release members such that the lifting lugs are in the spearhead unlatched configuration upon a second further displacement of the sleeve towards the tubular opening of the elongated body.

25. The device according to claim 20, further comprising:

an underground adapter with a propulsion seal to propel the overshot device through the drill string using fluid under pressure.

26. The device according to claim 25, wherein the adapter is directly mounted on the device.

27. The device according to claim 25, wherein the adapter comprises:

an upper latch body comprising:

an upper central bore;

an upper port system for fluidly connecting an outer surface of the upper latch body to the upper central bore; and a reduced diametric portion below the upper central bore for receiving at least one seal member, said reduced diametric portion comprising a lower coupling portion on a bottom portion thereof;

a lower latch body comprising:

an upper coupling portion coupled to the lower coupling portion of the upper latch body;

a lower central bore, in fluid communication with the upper central bore; and a lower port system for fluidly connecting an outer surface of the lower latch body to the lower central bore;

a valve system for controlling fluid flow between the upper port system and the lower port system;

a wireline retention device mounted above the upper latch body; and a coupling device for coupling the lower latch body to the overshot device.

28. A method of operating an overshot device comprising:

providing an overshot device comprising:

an elongated body adapted to be connected to a hoisting line in one end and with a tubular opening receiving a spearhead in the other end, said elongated body comprising:

first and second axially extending slots;

first and second locking dog seats;

two lifting dogs comprising first and second lifting lugs arranged to pivot around a common lifting dog pivot pin, said lifting lugs being configurable between a spearhead latched configuration and a spearhead unlatched configuration, each lifting lug comprising a spearhead capture member and a spearhead release member, the spearhead capture member being adapted to capture the spearhead, the two lifting dogs being axially slidable with respect to the elongated body;

a lifting dog biasing element configured to connect the lifting lugs and urge the lifting lugs towards the spearhead latched configuration;

two locking dogs comprising first and second locking lugs arranged to pivot around a common locking dog pivot pin, said locking lugs being configurable between a lifting dog locked configuration and a lifting dog unlocked configuration, each locking lug comprising a lifting dog locking member and a lifting dog release member, the lifting dog locking member being adapted to lock the lifting dogs in the spearhead latched configuration, the two locking dogs being axially slidable with respect to the elongated body;

a locking dog biasing element configured to connect the locking lugs and urge the locking lugs towards the lifting lug locked configuration; and a pair of sliding bars connected to the common lifting dog pivot pin, and further connected therebetween with a lifting dog retention pin;

lowering the locking dogs to force the locking dogs into the lifting dog unlocked configuration in which the lifting dog locking members releasably interlock with the first and second locking dog seats; and raising upward the lifting dog retention pin to displace the pair of sliding bars along the axially extending slots of the elongated body and into contact with the lifting dog locking members thereby separating the lifting dog locking members from the first and second locking dog seats and configuring the locking lugs in the lifting dog locked configuration.

29. The method according to claim 28, wherein the raising is accomplished with the spearhead entering the tubular opening of the elongated body.

30. The method according to claim 28, wherein the lifting dog biasing element comprises a compression spring connecting the spearhead release members of the lifting lugs.

31. The method according to claim 28, wherein the locking dog biasing element comprises a compression spring connecting the lifting dog release members of the locking lugs.

32. The method according to claim 28, wherein the lifting dog locking members of the locking dogs are arranged to be positioned between the spearhead release members of the lifting dogs when the locking lugs are in the lifting dog locked configuration.

33. The method according to claim 28, further comprising:

sliding a releasing sleeve axially along the elongated body, to compress the lifting dog release members such that the locking lugs are in the lifting lug unlatched configuration upon a first displacement of the sleeve towards the tubular opening of the elongated body, and to further compress the spearhead release members such that the lifting lugs are in the spearhead unlatched configuration upon a second further displacement of the sleeve towards the tubular opening of the elongated body.

34. A pivotable lifting lug comprising:

a spearhead release member for releasing a spearhead, the spearhead release member comprising:

a main pivoting element connectable to a lifting lug pivoting element; and a release arm extending at an extremity of the spearhead release member;

a spearhead capture member for capturing the spearhead, the spearhead capture member comprising:

a spearhead capture tip; and a release arm support portion opposite the spearhead capture tip and having a shape substantially complementary to a shape of the release arm;

a common pivoting element configured to pivotably connecting the spearhead release member to the spearhead capture member; and a lifting lug biasing element configured to urge the spearhead capture member against the release arm of the spearhead release member.

* * * * *